US009206661B2

(12) United States Patent
Guidry

(10) Patent No.: US 9,206,661 B2
(45) **Date of Patent: *Dec. 8, 2015**

(54) UNIVERSAL FRAC SLEEVE

(71) Applicant: Cameron International Corporation, Houston, TX (US)

(72) Inventor: Kirk P. Guidry, Cypress, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/590,204

(22) Filed: Jan. 6, 2015

(65) Prior Publication Data

US 2015/0107821 A1 Apr. 23, 2015

Related U.S. Application Data

(63) Continuation of application No. 13/257,964, filed as application No. PCT/US2010/033028 on Apr. 29, 2010, now Pat. No. 8,936,075.

(60) Provisional application No. 61/175,439, filed on May 4, 2009.

(51) Int. Cl.

| | |
|---|---|
| ***E21B 33/03*** | (2006.01) |
| ***E21B 34/02*** | (2006.01) |
| ***E21B 33/068*** | (2006.01) |
| ***E21B 43/26*** | (2006.01) |

(52) U.S. Cl.

CPC ..... *E21B 33/03* (2013.01); *E21B 33/068* (2013.01); *E21B 34/02* (2013.01); *E21B 43/26* (2013.01)

(58) Field of Classification Search

CPC ..... E21B 33/03; E21B 33/068; E21B 33/05; E21B 43/26; E21B 34/02

USPC ..... 166/177.5, 281, 308.1, 382, 316, 86.2, 166/88.1, 95.1

See application file for complete search history.

(56) References Cited

U.S. PATENT DOCUMENTS

| | | | | |
|---|---|---|---|---|
| 7,743,824 | B2 | 6/2010 | Lam et al. | |
| 8,936,075 | B2 * | 1/2015 | Guidry | 166/177.5 |
| 2003/0205385 | A1 | 11/2003 | Duhn et al. | |
| 2006/0185841 | A1 | 8/2006 | Swagerty et al. | |
| 2008/0035326 | A1 | 2/2008 | Cherewyk | |
| 2008/0083539 | A1 | 4/2008 | Hickie | |
| 2008/0190601 | A1 | 8/2008 | Swagerty et al. | |
| 2008/0230226 | A1 | 9/2008 | Lam et al. | |
| 2009/0090515 | A1 | 4/2009 | Chan et al. | |
| 2011/0155367 | A1 | 6/2011 | Swagerty et al. | |
| 2012/0037356 | A1 | 2/2012 | Guidry | |
| 2013/0014947 | A1 | 1/2013 | Wilkins et al. | |

OTHER PUBLICATIONS

PCT International Search Report and Written Opinion; Application No. PCT/US2010/033028; Dated Nov. 3, 2010; 13 pages.

Singapore Written Opinion; Application No. 201107041-4; Dated Jun. 25, 2012; 6 pages.

United Kingdom Patents Act 1977 Combined Search and Examination Report; Application No. GB1316106.2; Dated Oct. 21, 2013; 3 pages.

* cited by examiner

*Primary Examiner* — Daniel P Stephenson

(74) *Attorney, Agent, or Firm* — Fletcher Yoder P.C.

(57) ABSTRACT

A wellhead assembly is provided. In one embodiment, the wellhead assembly includes a universal frac sleeve assembly for isolating portions of a wellhead assembly from pressurized fracing fluid. The universal frac sleeve assembly may include an inner sleeve, an outer sleeve, and a seal. Axial movement of the inner sleeve relative to the outer sleeve causes the seal to expand radially, thereby forming a seal within the wellhead assembly.

26 Claims, 5 Drawing Sheets

UNIVERSAL FRAC SLEEVE

CROSS REFERENCE TO RELATED APPLICATIONS

This application claims priority to and benefit of U.S. Non-Provisional patent application Ser. No. 13/257,964, entitled "Universal Frac Sleeve", filed on Sep. 20, 2011, which is herein incorporated by reference in its entirety, and which claims priority to and benefit of PCT Patent Application No. PCT/US2010/033028, entitled "Universal Frac Sleeve", filed on Apr. 29, 2010, which is herein incorporated by reference in its entirety, and which claims priority to and benefit of U.S. Provisional Patent Application No. 61/175,439, entitled "Universal Frac Sleeve", filed on May 4, 2009, which is herein incorporated by reference in its entirety.

FIELD OF THE INVENTION

The present invention relates generally to devices that couple to wellheads. More particularly, the present invention relates to devices configured to isolate portions of wellheads from fluid pressure.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Wells are frequently used to extract fluids, such as oil, gas, and water, from subterranean reserves. These fluids, however, are often expensive to extract because they naturally flow relatively slowly to the well bore. Frequently, a substantial portion of the fluid is separated from the well by bodies of rock and other solid materials. These solid formations impede fluid flow to the well and tend to reduce the well's rate of production.

This effect, however, can be mitigated with certain well-enhancement techniques. Well output often can be boosted by hydraulically fracturing the rock disposed near the bottom of the well, using a process referred to as "fracing." To frac a well, a fracturing fluid is pumped into the well until the down-hole pressure rises, causing cracks to form in the surrounding rock. The fracturing fluid flows into the cracks and propagates them away from the well, toward more distant fluid reserves. To impede the cracks from closing after the fracing pressure is removed, the fracturing fluid typically carries a substance referred to as a proppant. The proppant is typically a solid, permeable material, such as sand, that remains in the cracks and holds them at least partially open after the fracturing pressure is released. The resulting porous passages provide a lower-resistance path for the extracted fluid to flow to the well bore, increasing the well's rate of production.

Fracing a well often produces pressures in the well that are greater than the pressure-rating of certain well components. For example, some wellheads are rated for pressures up to 5,000 psi, a rating which is often adequate for pressures naturally arising from the extracted fluid, but some fracing operations can produce pressures that are greater than 10,000 psi. Thus, there is a need to protect some wellhead components from fluid pressure arising from well fracing.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF SPECIFIC EMBODIMENTS

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," "said," and the like, are intended to mean that there are one or more of the elements. The terms "comprising," "including," "having," and the like are intended to be inclusive and mean that there may be additional elements other than the listed elements. Moreover, the use of "top," "bottom," "above," "below," and variations of these terms is made for convenience, but does not require any particular orientation of the components.

Figure 1:
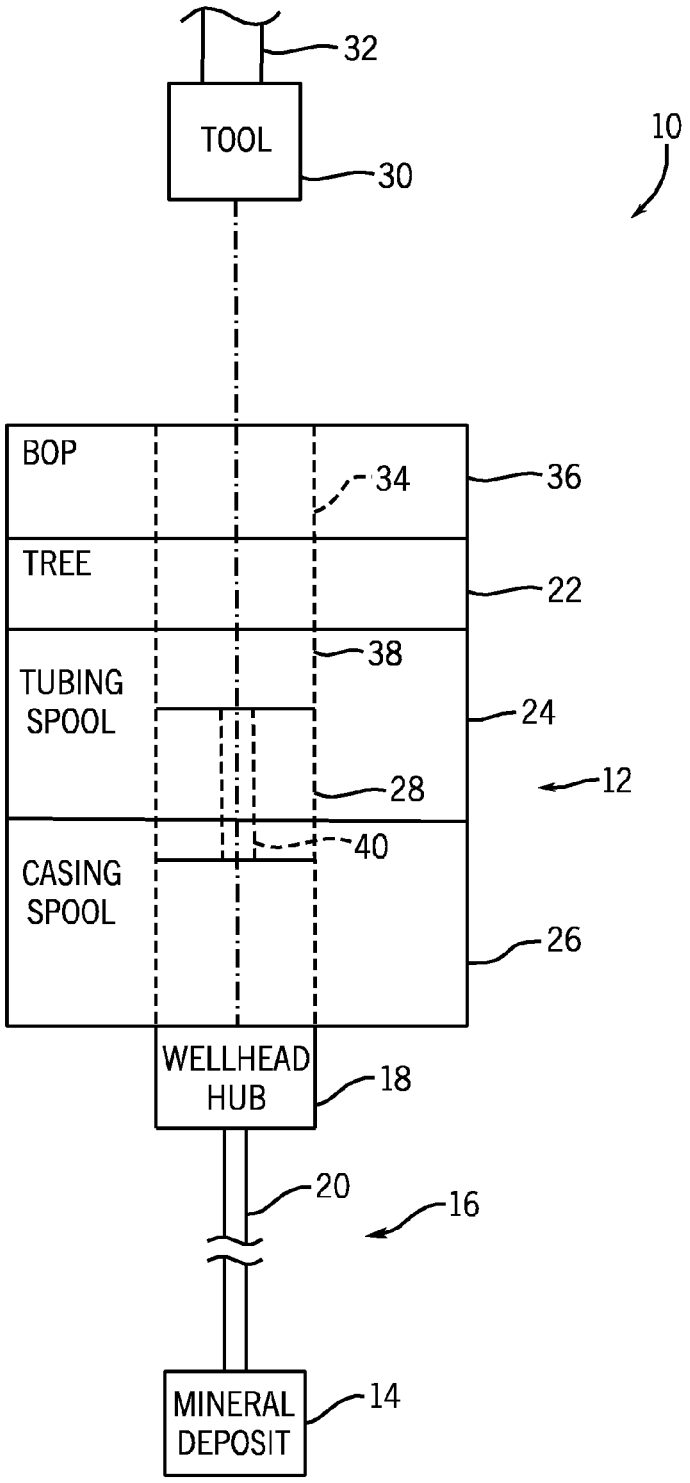
FIG. 1 is a block diagram illustrating a mineral extraction system in accordance with an embodiment of the present invention.

FIG. 1 is a block diagram that illustrates an embodiment of a mineral extraction system 10. As discussed below, a universal frac sleeve assembly may be employed with the system 10. The illustrated mineral extraction system 10 may be configured to extract various minerals and natural resources, including hydrocarbons (e.g., oil and/or natural gas), from the earth, or to inject substances into the earth. In some embodiments, the mineral extraction system 10 is land-based (e.g., a surface system) or sub-sea (e.g., a sub-sea system). As illustrated, the system 10 includes a wellhead assembly 12 coupled to a mineral deposit 14 via a well 16. The well 16 may include a wellhead hub 18 and a well bore 20. The wellhead hub 18 generally includes a large diameter hub disposed at the termination of the well bore 20 and designed to connect the wellhead assembly 12 to the well 16.

The wellhead assembly 12 may include multiple components that control and regulate activities and conditions associated with the well 16. For example, the wellhead assembly 12 generally includes bodies, valves, and seals that route produced minerals from the mineral deposit 14, regulate pressure in the well 16, and inject chemicals down-hole into the well bore 20. In the illustrated embodiment, the wellhead assembly 12 includes what is colloquially referred to as a Christmas tree 22 (hereinafter, a "tree"), a tubing spool 24, a casing spool 26, and a hanger 28 (e.g., a tubing hanger and/or a casing hanger). The system 10 may include other devices that are coupled to the wellhead assembly 12, and devices that are used to assemble and control various components of the wellhead assembly 12. For example, in the illustrated embodiment, the system 10 includes a running tool 30 suspended from a drill string 32. In certain embodiments, the running tool 30 is lowered (e.g., run) from an offshore vessel to the well 16 and/or the wellhead assembly 12. In other embodiments, such as surface systems, the running tool 30 may include a device suspended over and/or lowered into the wellhead assembly 12 via a crane or other supporting device.

The tree 22 generally includes a variety of flow paths (e.g., bores), valves, fittings, and controls for operating the well 16. For instance, the tree 22 may include a frame that is disposed about a tree body, a flow-loop, actuators, and valves. Further, the tree 22 may provide fluid communication with the well 16. For example, the tree 22 includes a tree bore 34. The tree bore 34 provides for completion and workover procedures, such as the insertion of tools into the well 16, the injection of various chemicals into the well 16, and so forth. Further, minerals extracted from the well 16 (e.g., oil and natural gas) may be regulated and routed via the tree 22. For instance, the tree 22 may be coupled to a jumper or a flowline that is tied back to other components, such as a manifold. Accordingly, produced minerals may flow from the well 16 to the manifold via the wellhead assembly 12 and/or the tree 22 before being routed to shipping or storage facilities. A blowout preventer (BOP) 36 may also be included, either as a part of the tree 22 or as a separate device. The BOP 36 may consist of a variety of valves, fittings, and controls to prevent oil, gas, or other fluid from exiting the well in the event of an unintentional release of pressure or an overpressure condition.

The tubing spool 24 provides a base for the tree 22. Typically, the tubing spool 24 is one of many components in a modular sub-sea or surface mineral extraction system 10 that is run from an offshore vessel or surface system. The tubing spool 24 includes a tubing spool bore 38. The tubing spool bore 38 connects (e.g., enables fluid communication between) the tree bore 34 and the well 16. Thus, the tubing spool bore 38 may provide access to the well bore 20 for various completion and workover procedures. For example, components can be run down to the wellhead assembly 12 and disposed in the tubing spool bore 38 to seal off the well bore 20, to inject chemicals down-hole, to suspend tools down-hole, to retrieve tools down-hole, and so forth.

The well bore 20 may contain elevated pressures. For example, the well bore 20 may include pressures that exceed 10,000, 15,000, or even 20,000 pounds per square inch (psi). Accordingly, the mineral extraction system 10 may employ various mechanisms, such as seals, plugs, and valves, to control and regulate the well 16. For example, plugs and valves are employed to regulate the flow and pressures of fluids in various bores and channels throughout the mineral extraction system 10. For instance, the illustrated hanger 28 (e.g., tubing hanger or casing hanger) is typically disposed within the wellhead assembly 12 to secure tubing and casing suspended in the well bore 20, and to provide a path for hydraulic control fluid, chemical injections, and so forth. The hanger 28 includes a hanger bore 40 that extends through the center of the hanger 28, and that is in fluid communication with the tubing spool bore 38 and the well bore 20. One or more seals may be disposed between the hanger 28 and the tubing spool 24 and/or the casing spool 26.

Figure 2:
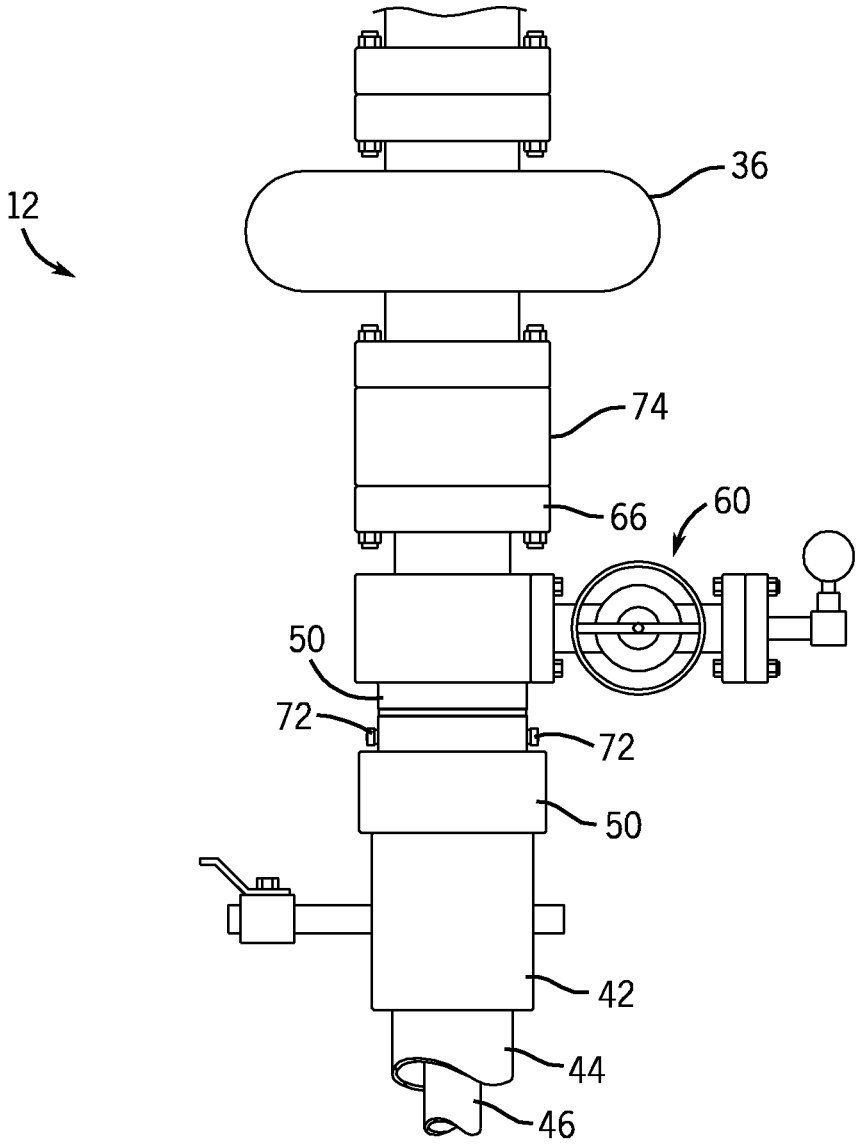
FIG. 2 is a side view of an exemplary embodiment of the wellhead assembly of FIG. 1 which may be adapted to receive a universal frac sleeve assembly.
Figure 3:
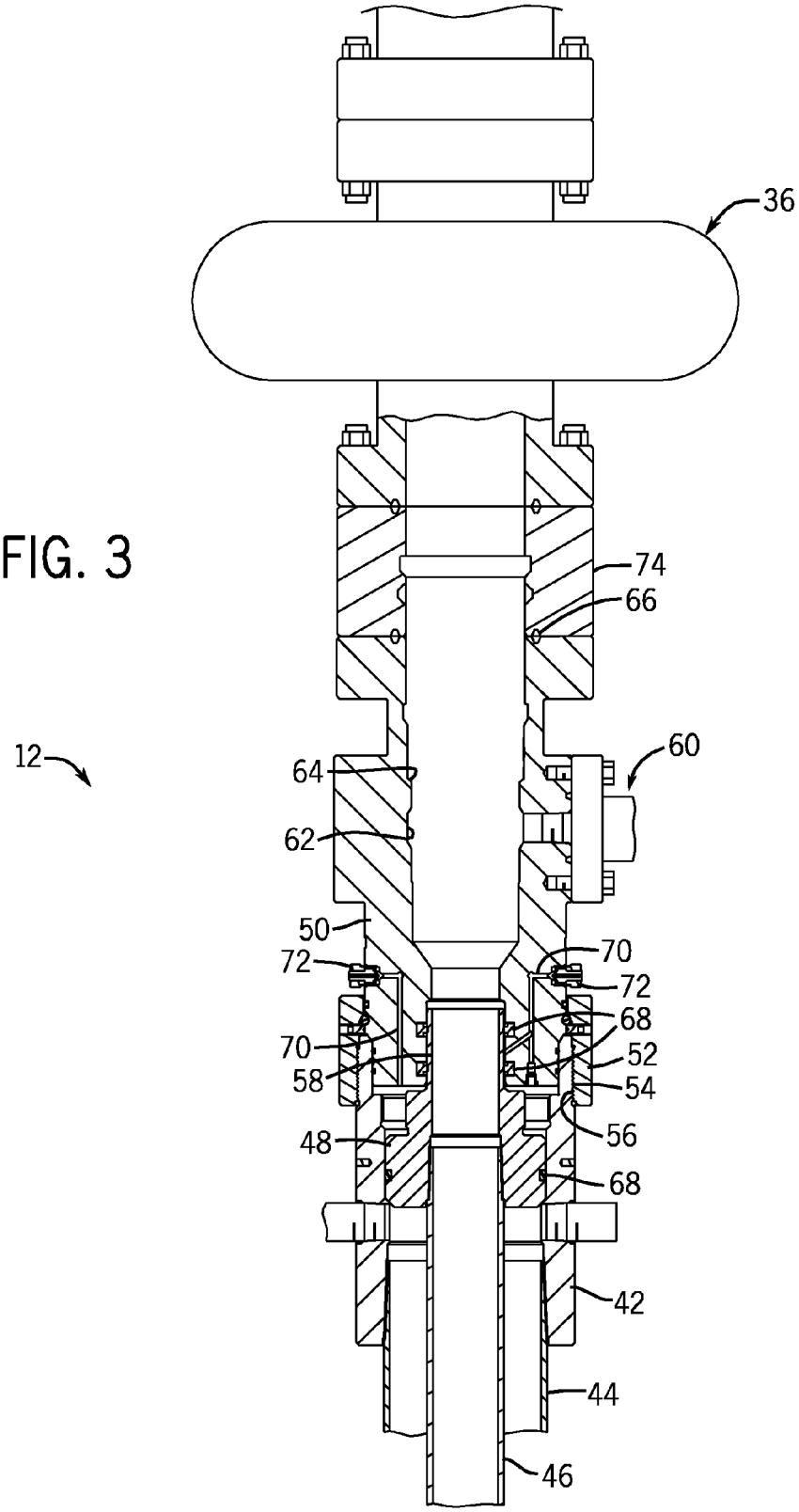
FIG. 3 is a cross-sectional side view of an exemplary embodiment of the wellhead assembly of FIG. 1 which may be adapted to receive the universal frac sleeve assembly.

FIGS. 2 and 3 illustrate exemplary embodiments of the wellhead assembly 12 of FIG. 1. The illustrated wellhead assembly 12 is a surface wellhead, but the present technique is not limited to surface applications. Some embodiments may include a subsea tree. The exemplary wellhead assembly 12 includes a casing head 42 coupled to a surface casing 44. The wellhead assembly 12 also includes a production casing 46, which may be suspended within the casing head 42 and the surface casing 44 via a casing hanger 48. It will be appreciated that a variety of additional components may be coupled to the casing head 42 to facilitate production from a subterranean well.

For instance, in one embodiment, a tubing head 50 is coupled to the casing head 42. In the presently illustrated embodiment, the tubing head 50 is coupled to the casing head 42 via a union nut 52, which is threaded onto the casing head 42 via complementary threaded surfaces 54 and 56. Of course, it will be appreciated that wellhead members, such as the tubing head 50, may be coupled to the casing head 42 in any suitable manner, including through the use of various other connectors, collars, or the like. In one embodiment, the tubing head 50 may be adapted to receive an extended portion 58 of the casing hanger 48.

A valve assembly 60 is coupled to the exemplary tubing head 50 and may serve various purposes, including releasing pressure from an internal bore 62 of the tubing head 50. The internal bore 62 of the tubing head 50 is configured to receive one or more additional wellhead members or components, such as the universal frac sleeve assembly described below. As will be appreciated, operating pressures within the wellhead assembly 12 are typically greater during a fracturing process than during ordinary production. In order to protect components of the wellhead assembly 12 having a lower pressure rating (i.e., below the expected fracturing pressure) from such excessive pressure, the universal frac sleeve assembly may be introduced within the bore 62 to isolate the portions of the wellhead assembly 12 from at least some of this pressure.

The exemplary tubing head 50 includes a sloped landing surface 64 configured to abut a shoulder of the universal frac sleeve assembly described below. In some embodiments, these structures cooperate to axially position the universal frac sleeve assembly in the wellhead assembly 12, as explained below. The exemplary tubing head 50 also includes a flange 66 configured to facilitate coupling of various components or wellhead members.

The exemplary wellhead assembly 12 includes various seals 68 to isolate pressures within different sections of the wellhead assembly 12. For instance, as illustrated, such seals 68 include seals disposed between the casing head 42 and the casing hanger 48 and between the casing hanger 48 and the tubing head 50. Further, various components of the wellhead assembly 12, such as the tubing head 50, may include internal passageways 70 that allow testing of one or more of the seals 68. When not being used for such testing, these internal passageways 70 may be sealed from the exterior via pressure barriers 72.

The illustrated wellhead assembly 12 also includes an adapter 74 and the BOP 36. The adapter 74 couples to the tubing head 50 via the flange 66. The illustrated BOP 36 couples to the wellhead assembly 12 via the adapter 74. The BOP 36 may include a valve and a valve actuator, such as a hydraulic actuator, configured to close the valve. The BOP 36 is configured to close the bore 62 if the pressure in the bore 62 exceeds some threshold condition. In other embodiments, other devices may be connected to the flange 66 or the adapter 74. For example, the christmas tree 22 or a frac tree may be connected to one of these components.

As discussed above, fracing a well 16 often produces pressures in the well 16 that are greater than the pressure rating of certain well components. For example, some wellhead assemblies 12 are rated for pressures up to 5,000 psi, a rating which is often adequate for pressures naturally arising from the extracted fluid, but some fracing operations can produce pressures that are greater than 10,000 psi. In these instances, it may be desirable to isolate certain components of the wellhead assembly 12 from these elevated pressures. For example, in certain instances, it may be desirable to isolate the valve assembly 60. A universal frac sleeve assembly may be used to isolate components of the wellhead assembly 12.

Figure 4:
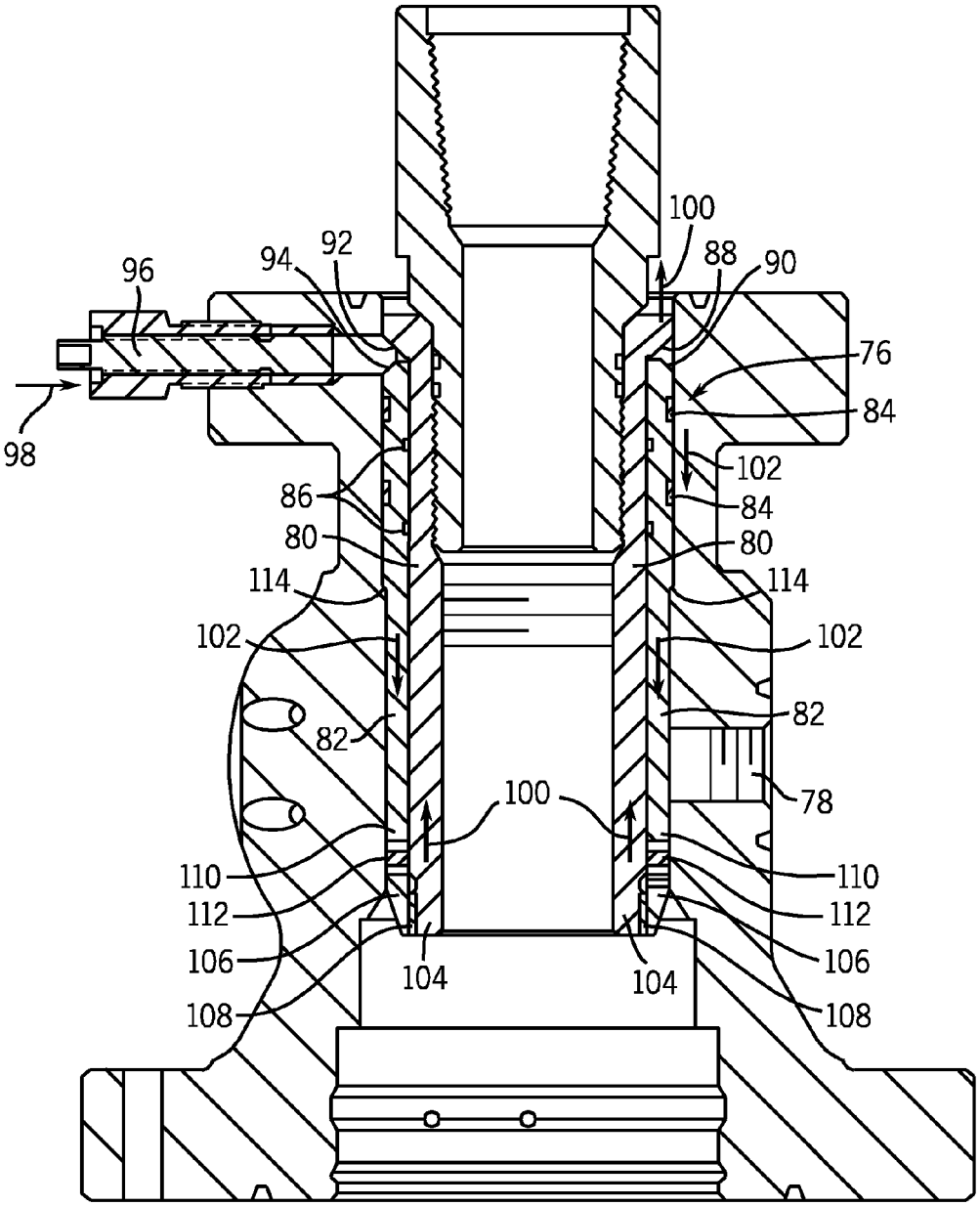
FIG. 4 is a cross-sectional side view of an exemplary embodiment of the universal frac sleeve assembly.

FIG. 4 is a cross-sectional side view of an exemplary embodiment of a universal frac sleeve assembly 76. As discussed below, the universal frac sleeve assembly 76 is configured to mount in tubing (e.g., tubing head 50) within a range of diameters, rather than being limited to one specific diameter of tubing. In other words, the universal frac sleeve assembly 76 is not specifically machined for one tubing diameter, but rather it is able to adapt to multiple tubing diameters. For example, the universal frac sleeve assembly 76 is designed to radially expand into a sealing configuration, thereby providing universal mounting in different tubing. As discussed below, the universal frac sleeve assembly 76 includes multiple components configured to move relative to another to cause radial expansion from a first diameter to a second diameter. Although the following discussion relates to a mechanical actuation, any suitable hydraulic or other actuation may be used to cause the radial expansion to facilitate sealing in a variety of tubing.

As illustrated, in certain embodiments, the universal frac sleeve assembly 76 may be configured to be positioned within the tubing head 50 to isolate certain components of the wellhead assembly 12 from higher pressures during fracing operations. For example, as illustrated, the universal frac sleeve assembly 76 may isolate an outlet connector 78 associated with the valve assembly 60 from the elevated fracing pressures. As illustrated, the universal frac sleeve assembly 76 may include an inner sleeve 80 and an outer sleeve 82, e.g., annular structures, which are concentric with one another. In certain embodiments, the universal frac sleeve assembly 76 may include at least one outer isolation seal 84 (e.g., annular seal) between the outer sleeve 82 and the tubing head 50 for sealing between the universal frac sleeve assembly 76 and the tubing head 50. In addition, the universal frac sleeve assembly 76 may include at least one inner isolation seal 86 (e.g., annular seal) between the inner sleeve 80 and the outer sleeve 82 for sealing between the sleeves 80, 82.

As illustrated, the inner and outer sleeves 80, 82 may include inner chamfered edges 88, 90 toward upper axial ends of the inner and outer sleeve 80, 82, respectively. These inner chamfered edges 88, 90 may be configured to mate with outer chamfered edges 92, 94 on an end of a lock screw 96, which may be configured to screw radially into a side of the tubing head 50. In particular, as the lock screw 96 screws into the tubing head 50, it may generally move radially into the tubing head 50, as illustrated by arrow 98. As the lock screw 96 moves radially into the tubing head 50, the outer chamfered edges 92, 94 on the end of the lock screw 96 may exert a radially inward force on the inner chamfered edges 88, 90 of the inner and outer sleeves 80, 82, respectively. In addition, this radially inward force may also cause the inner and outer sleeve 80, 82 to move axially relative to one another, as illustrated by arrows 100 and 102. In particular, the radially inward force imparted by the lock screw 96 causes opposite axial motion of the inner and outer sleeve 80, 82.

A lower end 104 of the inner sleeve 80 may be connected to a retainer ring 106. The retainer ring 106 may generally be a ring-like structure which, in certain embodiments, may be connected to the inner sleeve 80 via threading 108. However, in other embodiments, the retainer ring 106 may be an integral part of the inner sleeve 80. As the inner and outer sleeves 80, 82 begin moving axially relative to each other, the retainer ring 106 may begin moving axially toward a lower end 110 of the outer sleeve 82. An energizing seal 112 (e.g., annular seal) is positioned between the lower end 110 of the outer sleeve 82 and the retainer ring 106. As the retainer ring 106 moves axially toward the lower end 110 of the outer sleeve 82, a compressive axial force may be applied to the energizing seal 112. As such, the energizing seal 112 may be compressed in an axial direction and, conversely, may expand in a radial direction. The radial expansion of the energizing seal 112 may cause the energizing seal 112 to form a seal against the tubing head 50, thereby isolating the outlet connector 78 of the valve assembly 60 from the elevated fracing pressures.

As such, the energizing seal 112 may be energized using mechanical forces applied directly to the two-piece universal frac sleeve assembly 76. Although illustrated in FIG. 4 as being applied via a mechanical actuation mechanism (e.g., the lock screw 96), in certain embodiments, the energizing seal 112 may be energized using a hydraulic actuation mechanism or any suitable actuation mechanism. As illustrated, the outer sleeve 82 may land on a landing shoulder 114. As such, when being lowered into the wellhead assembly 12, the energizing seal 112 is able to clear the smaller inner diameter of the tubing head 50. However, when energized, the energizing seal 112 is configured to seal against the larger inner diameter of the tubing head 50. The ability of the universal frac sleeve assembly 76 to seal against the tubing head 50 in this manner below the extrusion gap may enable the universal frac sleeve assembly 76 to work with numerous different wellhead assemblies 12. In addition, the two-piece nature of the universal frac sleeve assembly 76 further provides flexibility in working with numerous different wellhead assemblies 12. For example, the radial expandability of the energizing seal 112 enables the universal frac sleeve assembly 76 to mount in tubing of different diameters, rather than being limited to a specific diameter.

The energizing seal 112 may generally be comprised of an elastomer (e.g., rubber). However, other materials may also be used for the energizing seal 112. For example, the energizing seal 112 may include a resilient core with rigid end caps, e.g., an elastomer core with metal end caps. The inner and outer sleeves 80, 82 may generally be comprised of high-strength alloy steels. However, again, other materials may also be used for the inner and outer sleeves 80, 82.

Figure 5:
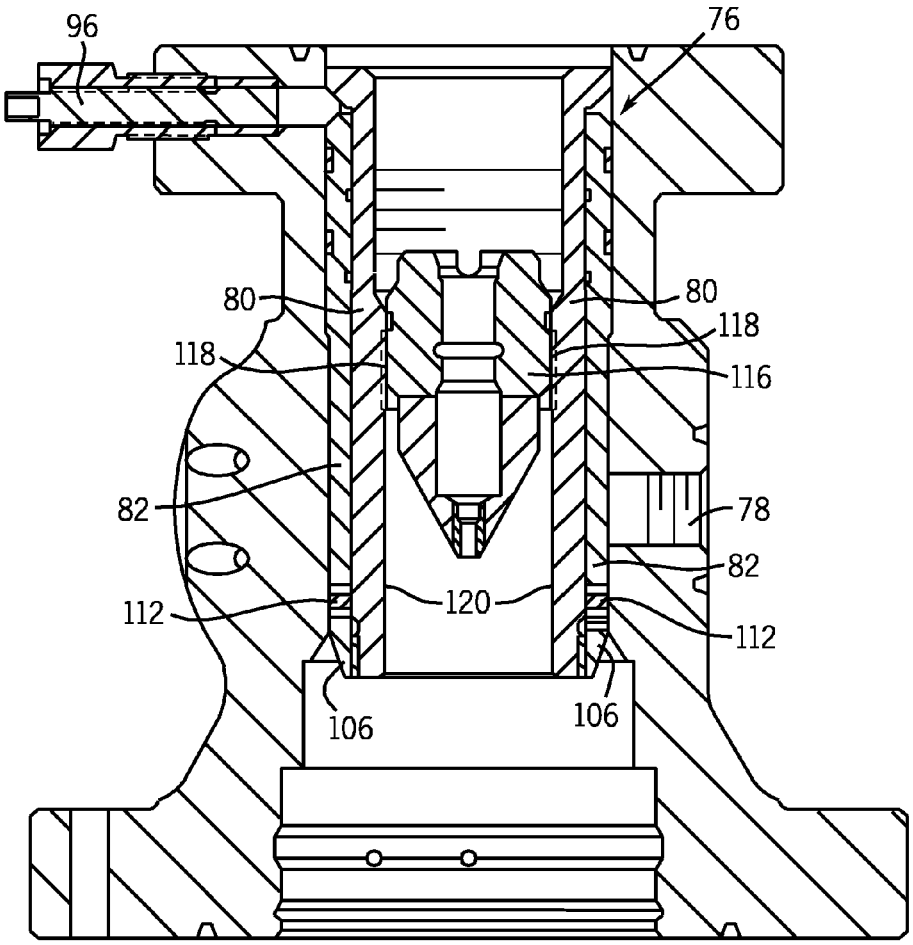
FIG. 5 is a cross-sectional side view of an exemplary embodiment of the universal frac sleeve assembly using a pressure barrier.

FIG. 5 is a cross-sectional side view of another exemplary embodiment of the universal frac sleeve assembly 76. In particular, FIG. 5 illustrates an embodiment of the universal frac sleeve assembly 76 configured to have a pressure barrier 116 installed within the inner sleeve 80, thereby further isolating components of the wellhead assembly 12 from the higher fracing pressures. The pressure barrier 116 may, for instance, include a back pressure valve. In certain embodiments, the pressure barrier 116 may be configured to mate with threading 118 on an inner wall 120 of the inner sleeve 80.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a frac sleeve assembly, comprising:

an inner sleeve;

an outer sleeve; and an annular seal, disposed about an outer circumference of the frac sleeve assembly, wherein the annular seal is configured to expand in an outward radial direction in response to movement between the inner sleeve and the outer sleeve.

2. The system of claim 1, wherein the annular seal is configured to expand in the outward radial direction in response to an axial movement between the inner sleeve and the outer sleeve.

3. The system of claim 1, comprising a radial actuator configured to apply a radial force against at least one tapered surface to drive the movement between the inner sleeve and the outer sleeve.

4. The system of claim 3, wherein the radial actuator comprises a threaded member.

5. The system of claim 3, wherein the at least one tapered surface is disposed on the inner sleeve.

6. The system of claim 3, wherein the at least one tapered surface is disposed on the outer sleeve.

7. The system of claim 3, wherein the at least one tapered surface comprises a first tapered surface disposed on the inner sleeve and a second tapered surface disposed on the outer sleeve.

8. The system of claim 1, wherein the annular seal is disposed about the inner sleeve.

9. The system of claim 8, wherein the annular seal is disposed axially between a first end portion of the inner sleeve and a second end portion of the outer sleeve.

10. The system of claim 8, wherein the first end portion of the inner sleeve comprises a retainer.

11. The system of claim 1, wherein the frac sleeve assembly comprises an inner isolation seal disposed between the inner and outer sleeves.

12. The system of claim 11, wherein the frac sleeve assembly comprises an outer isolation seal disposed about the outer circumference of the frac sleeve assembly.

13. The system of claim 1, wherein the frac sleeve assembly comprises a pressure barrier disposed within a central bore.

14. The system of claim 13, wherein the pressure barrier comprises a back pressure valve.

15. The system of claim 1, wherein the annular seal is configured to expand in the outward radial direction in response to movement between the inner sleeve and the outer sleeve to seal against a bore of a component of a mineral extraction system.

16. The system of claim 15, wherein the component comprises a head.

17. The system of claim 15, wherein the annular seal is configured to expand in the outward radial direction in response to movement between the inner sleeve and the outer sleeve to selectively seal the frac sleeve assembly to a plurality of different bore diameters.

18. A system, comprising:

a frac sleeve assembly, comprising:

an inner sleeve;

an outer sleeve; and a seal disposed about an outer circumference of the frac sleeve assembly, wherein the seal is configured to expand in an outward radial direction in response to movement between the inner sleeve and the outer sleeve to selectively seal the frac sleeve assembly to a plurality of different bore diameters.

19. The system of claim 18, comprising a head having a bore, wherein the seal is configured to expand in the outward radial direction in response to movement between the inner sleeve and the outer sleeve to selectively seal the frac sleeve assembly against the bore of the head.

20. The system of claim 18, comprising a radial actuator configured to apply a radial force against at least one tapered surface to drive the movement between the inner sleeve and the outer sleeve.

21. A system, comprising:

a frac sleeve assembly, comprising:

an inner sleeve having a first end portion;

an outer sleeve having a second end portion; and a seal disposed about the inner sleeve between the first and second end portions, wherein the frac sleeve assembly is configured to selectively energize the seal to seal the frac sleeve assembly to a plurality of different bore diameters.

22. The system of claim 21, wherein the seal is configured to expand in an outward radial direction in response to movement between the inner sleeve and the outer sleeve.

23. A frac sleeve assembly, comprising:

a first portion;

a second portion coupled to the first portion; and a seal disposed along an exterior of the frac sleeve assembly, wherein the seal is configured to expand in an outward radial direction in response to movement between the first and second portions of the frac sleeve assembly.

24. The frac sleeve assembly of claim 23, wherein the seal is configured to expand in the outward radial direction in response to movement between the first and second portions to seal against a bore of a component of a mineral extraction system.

25. The frac sleeve assembly of claim 23, wherein the frac sleeve assembly comprises a first seal disposed between the first and second portions, and a second seal disposed along the exterior of the frac sleeve assembly.

26. The frac sleeve assembly of claim 23, wherein the seal is configured to expand in an outward radial direction in response to axial movement between the first and second portions of the frac sleeve assembly.

* * * * *